US005730362A

United States Patent [19]

Cordes

[11] Patent Number: 5,730,362

[45] **Date of Patent: *Mar. 24, 1998**

[54] SHOWER HEAD WITH IMPACT PROTECTION PLATE

[75] Inventor: Dieter Cordes, Nettetal, Germany

[73] Assignee: Hansa Metallwerke-AG, Stuttgart, Germany

[ * ] Notice: The term of this patent shall not extend beyond the expiration date of Pat. No. 5,702,057.

[21] Appl. No.: 578,162

[22] Filed: Dec. 29, 1995

[30] Foreign Application Priority Data

Dec. 29, 1994 [DE] Germany ..... 44 47 113.0

[51] Int. Cl.[6] ..... B05B 15/02

[52] U.S. Cl. ..... 239/123; 239/447; 239/553; 239/596; 239/602

[58] Field of Search ..... 239/104, 106, 239/107, 109, 116, 117, 123, 548, 436, 552, 553, 555.3, 596, 602, DIG. 12

[56] References Cited

U.S. PATENT DOCUMENTS

| | | | |
|---|---|---|---|
| 2,402,741 | 6/1946 | Draviner | 239/602 |
| 4,629,124 | 12/1986 | Gruber | 239/428.5 |
| 5,172,862 | 12/1992 | Heimann et al. | 239/114 X |
| 5,228,625 | 7/1993 | Grassberger | 239/558 |
| 5,405,089 | 4/1995 | Heimann et al. | 239/602 |

FOREIGN PATENT DOCUMENTS

9017978 U 6/1993 Germany .

*Primary Examiner*—Andres Kashnikow
*Assistant Examiner*—Lisa Ann Douglas

[57] ABSTRACT

The shower base (1) of a shower head consists of a rigid perforated plate (1*a*), which has a number of holes (4, 5). Set into each of the holes (4, 5) in the perforated plate (1*a*) is a hose-type jet insert (6, 8) made of a flexible material which, owing to its material properties, can be flexed automatically to dislodge limescale deposits. The outer surface of the rigid perforated plate (1*a*), i.e. the surface of the shower base (1) which is visible to the user from underneath, is essentially completely covered by an impact resistant plate (1*b*) which is also made of a soft, flexible material. Of course the impact protection plate (1*b*) has collar-shaped lugs (12) going through it which are preformed on the perforated plate (1*a*) and which surround at least those hose-type jet inserts (8) which produce the high-power jets owing to their relatively narrow jet channel (9). The collar-shaped lugs (12), which are made of a rigid material, limit the volume of the jet insert (8), which, when flexed, contributes to the elastic deformation to a specific value, which would not be the case if the jet inserts (8) in question were preformed in one piece on the impact protection plate (1*b*). The latter configuration is, however, possible for those hose-type jet inserts (6), which produce the soft jets owing to their relatively wide jet channel (7).

7 Claims, 3 Drawing Sheets

SHOWER HEAD WITH IMPACT PROTECTION PLATE

Figure 1:
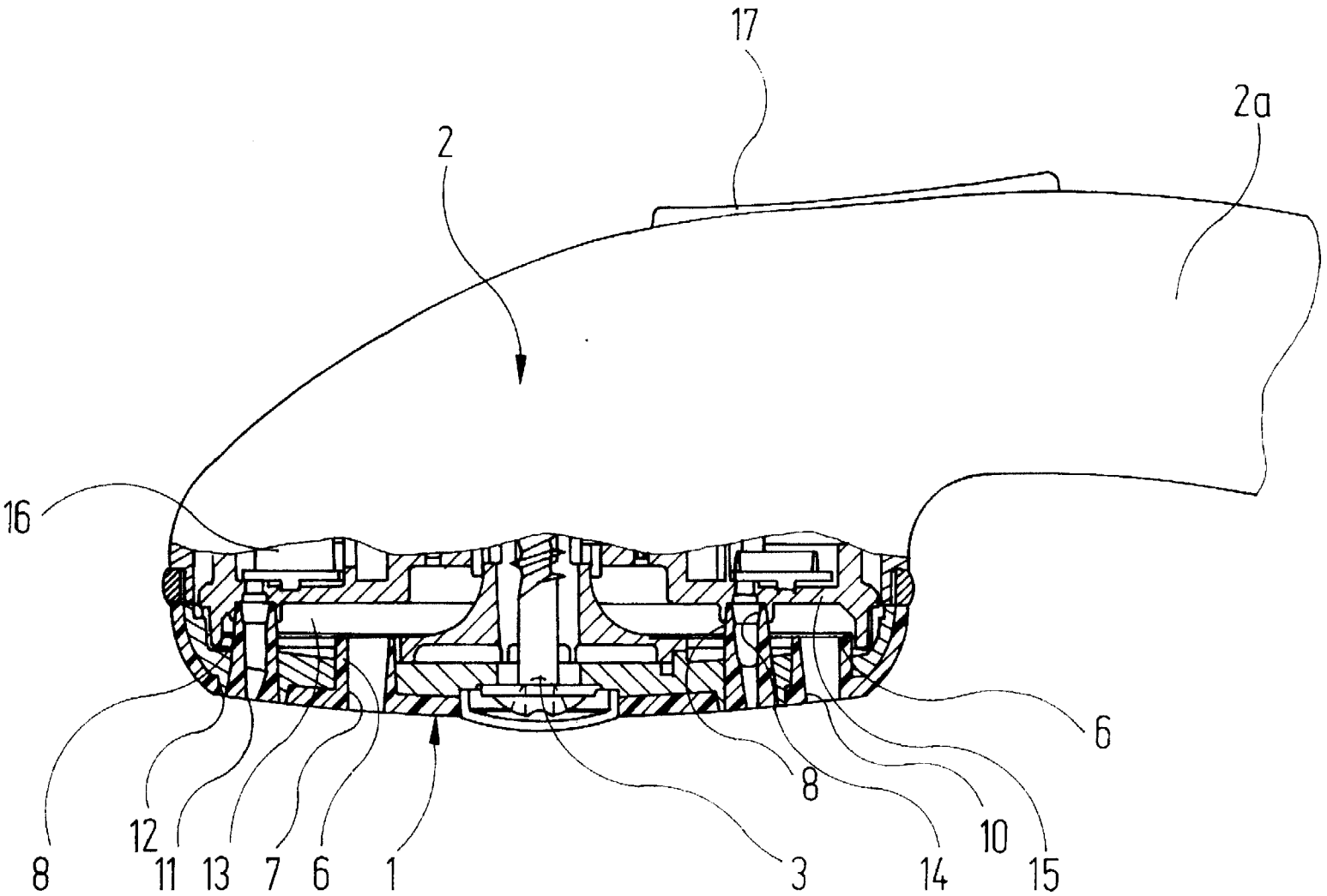

The invention concerns a shower head, especially for a hand shower, comprising a) an essentially bell-shaped housing, in which at least one water chamber is formed which can be connected to a water supply channel;

b) a shower base, which seals the bell-shaped housing at the bottom and consists of:

ba) a perforated plate made of a rigid material which has a number of holes;

bc) a number of hose-type jet inserts which are made of a relatively soft, flexible material, each of which has a jet channel going through them terminating in a water outlet opening and each of which passes through a hole in the perforated plate.

It is a known fact that the water outlet openings in shower bases have a tendency to fur up over the course of the useful life of the shower head. This manifests itself firstly as a jet pattern, the geometry of which differs from that when new, and also in a lower power output per liter delivered. The limescale deposits can build up until finally the water outlet openings are completely obstructed.

For this reason, it is known, for example as described in DE-GM 90 17 978 that water outlet openings are made on hose-type jet inserts which stand out a certain distance above the outer surface of the shower base. The hose-type jet inserts are made of an elastomer material and can be automatically flexed by stroking the hand over it so that the limescale deposited on the surfaces of the jet channels, particularly in the area around the water outlet openings, can be dislodged. The flow of water through the water outlet openings is then once again free running.

In view of the fact that some users regarded the jet inserts which protrude above the outer surface of the shower base as described in DE-GM 90 17 978 as being aesthetically unpleasing, DE-GM 93 03 986 describes hose-type jet inserts which are relocated in recesses in the shower base. By doing this, one free end of the hose-type jet inserts still points outwards. They are surrounded by circular spaces which open outwards, which allow the hose-type jet inserts the freedom of movement required for flexing. The disadvantage with this is that over time dirt can gather in the easily accessible circular spaces which is difficult to remove and which therefore has an unaesthetic effect and ultimately can obstruct the circular spaces to such an extent that the desired flexing effect of the jet inserts can no longer be achieved.

Both known types of shower head (DE-GM 90 17 978 and DE-GM 93 03 986) have the disadvantage that the outer surface of the shower base, i.e. that surface of the spray which the user sees from underneath, is essentially made of a rigid material, which can easily be damaged by impacts.

The task of this invention is to design a shower head of the type mentioned at the beginning which will allow the jet inserts to have sufficient flexing capacity to dislodge the limescale deposits without the circular spaces around the jet inserts and will also to a large extent protect the outer surface of the shower base from impacts.

This problem is solved by the invention in that c) essentially the entire outer surface of the perforated plate is covered by an impact protection plate made of a relatively soft, flexible material, but in which d) preformed on to the perforated plate are a number of collar-shaped lugs which go round the outer area of at least some of the hose-type nozzle inserts and separate these from the impact protection plate.

In order to understand the concept behind the invention properly, it is first of all necessary to imagine the dilemma facing the designer of a shower head: if he selects the very soft material used for the flexible jet inserts to facilitate the flexing capability then this would, it is true, avoid the circular spaces where there is a risk of dirt build-up. Here, however, there is a risk that the material used for the jet inserts and therefore the jet channel will deform elastically under the pressure of the water flowing through it and in this way the jet geometry will be pressure-dependent. This risk is particularly high especially for those jet inserts which produce the so-called "hard jets", as in this case the water pressure can reach quite high values. Moreover, the risk increases the less defined the volume of the flexible material, which contributes to the deformation caused by the water pressure. If an impact protection plate made of soft, flexible material is now introduced to protect the outer surface of the perforated plate of the shower base, then this would be the simplest solution from the manufacturing and engineering point of view and would offer the solution of making this impact protection plate in one piece with the various jet inserts. Then, however, the outer area of the jet inserts, i.e. the area close to the water outlet opening would just be connected to the impact protection plate such that a volume restriction of that material which contributes to the deformation caused by the water pressure is no longer possible. For this reason the collar-shaped lugs according to the invention are fitted to the perforated plate which separate the flexible material of the jet inserts, the deformation of which would otherwise be uncontrollable, from the material of the impact protection plate. The annular front faces of the collar-like lugs can protrude above the outer surface of the shower base, i.e. are visible, and therefore contribute to an optically pleasing and interesting shape of the shower base. At the same time, these visible annular areas can also be used as an indicating mark for the user who uses these to see where, if necessary, flexing should take place to dislodge limescale deposits from the jet channels.

The collar-like lugs fitted according to the invention and made of relatively rigid material have yet another effect: they intervene in the dynamics of the movement of the finger of a user which is moved along the impact protection plate of the shower base under pressure to flex the jet channels: given that the collar-like lugs are made of a relatively rigid material, the finger passing over it meets a resistance which does not happen with the otherwise flexible material of the impact protection plate. This stops the movement of the finger; the user instinctively attempts to counteract this by increasing the pressure. Under this increased pressure, the finger overcomes the obstacle presented by the collar-like lug and with constant pressure still at first applied ends up with increased speed in the area of the material of the jet insert which is surrounded by the collar-like lug. In this way, the flexing action is involuntarily increased in the area around this jet insert.

Many shower heads are so-called "twin function" or "multifunction" showers. This means that they generally consist of a first set of outlet openings, which are at the end of a comparatively wide jet channel and produce relatively slow speed, large cross-section soft jets to which air is added and also a second set of outlet openings which are at the end of a relatively narrow jet channel and produce relatively high-speed, hard jets with a small cross-section. The water which is generally supplied via the handle of the hand shower is transferred to one or the other sets of outlet openings by means of a change-over mechanism. With a configuration of the shower head of this kind, the design preferred according to the invention involves the provision of collar-like lugs for the perforated plate only on those hose-type jet inserts which produce the hard jets, whilst the hose-type jet inserts which produce the soft jets are preformed in one piece on the impact protection plate. The reason for the differing form of the hose-type jet inserts which produce the hard jets and those which produce the soft jets is that in the main the former are subject to the risk, as highlighted above, of uncontrolled elastic deformation caused by the "internal pressure" of the water flowing through them. As regards the hose-type jet inserts which produce the soft jets, the more simple design option can be used in which jet inserts and impact protection plate form a single piece.

In a particularly preferred configuration of the invention, the hose-type jet inserts which produce the soft jets and the hose-type jet inserts which produce the hard jets have a different axial length. In this way, it is possible for each of the shorter hose-type jet inserts to connect with a water chamber which directly adjoins the shower base in the housing of the shower head, whilst the longer hose-type jet inserts go through this first water chamber and their ends held inside holes in a dividing wall inside the housing, which divides the first water chamber from a second water chamber in the housing which is further away from the shower base.

For preference, the hose-type jet inserts and the impact protection plate are made of the same material.

From a manufacturing and engineering aspect, a particularly good embodiment of the invention is one in which the hose-type jet inserts and/or the impact protection plate are injection moulded on to the perforated plate using the two-component technique.

Under certain circumstances, however, it can also be advantageous for the hose-type jet inserts and/or the impact protection plate to be detachable from the perforated plate. With this design it is possible, when extreme dirt build-up occurs over quite a long period of time, to remove the hose-type jet inserts and/or the impact protection plate from the perforated plate and to carry out a separate, thorough cleaning.

In this connection, the recommendation is particularly for an embodiment in which the hose-type jet inserts and/or the impact protection plate are flexibly mounted on the perforated plate.

Figure 2:
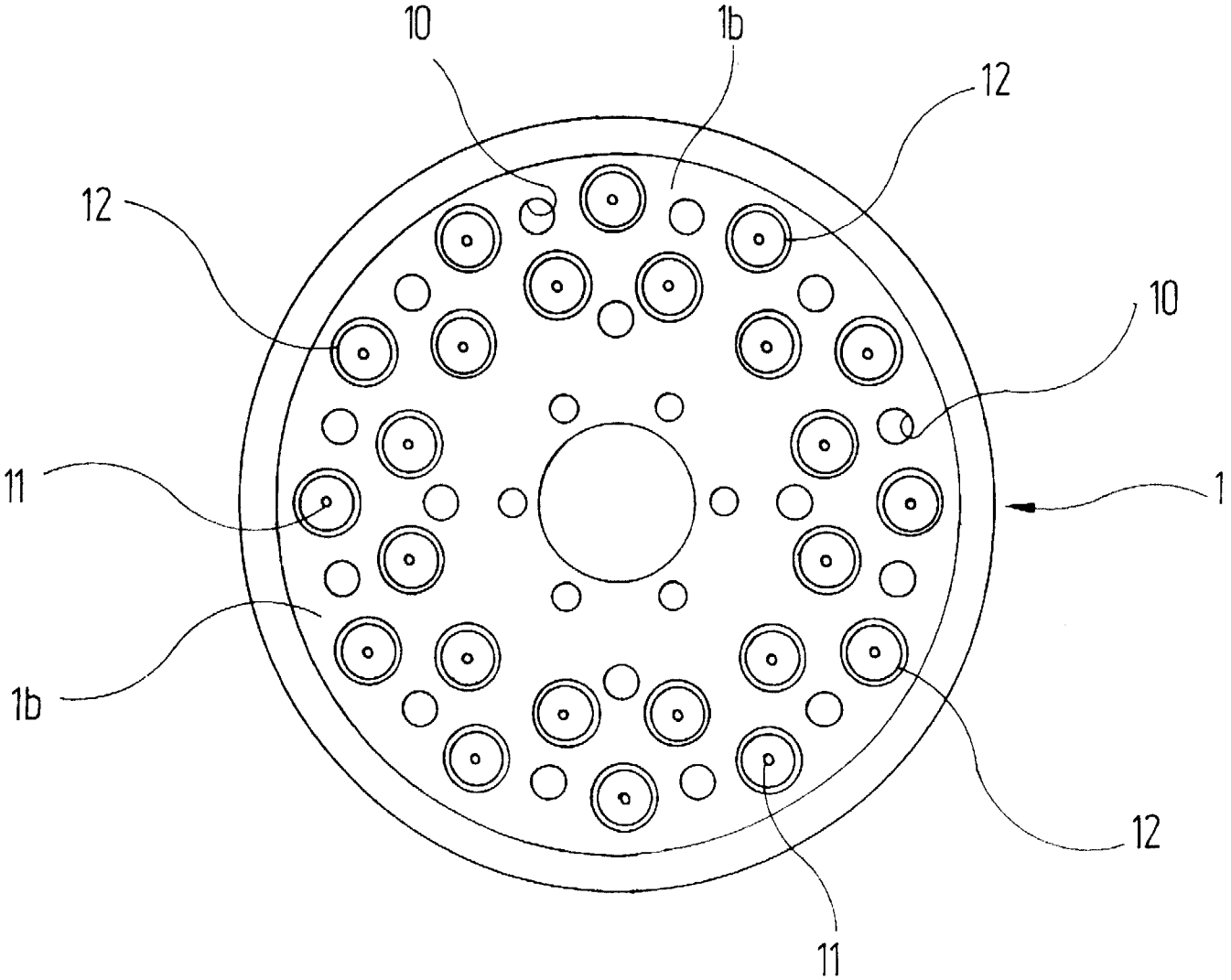
Figure 3:
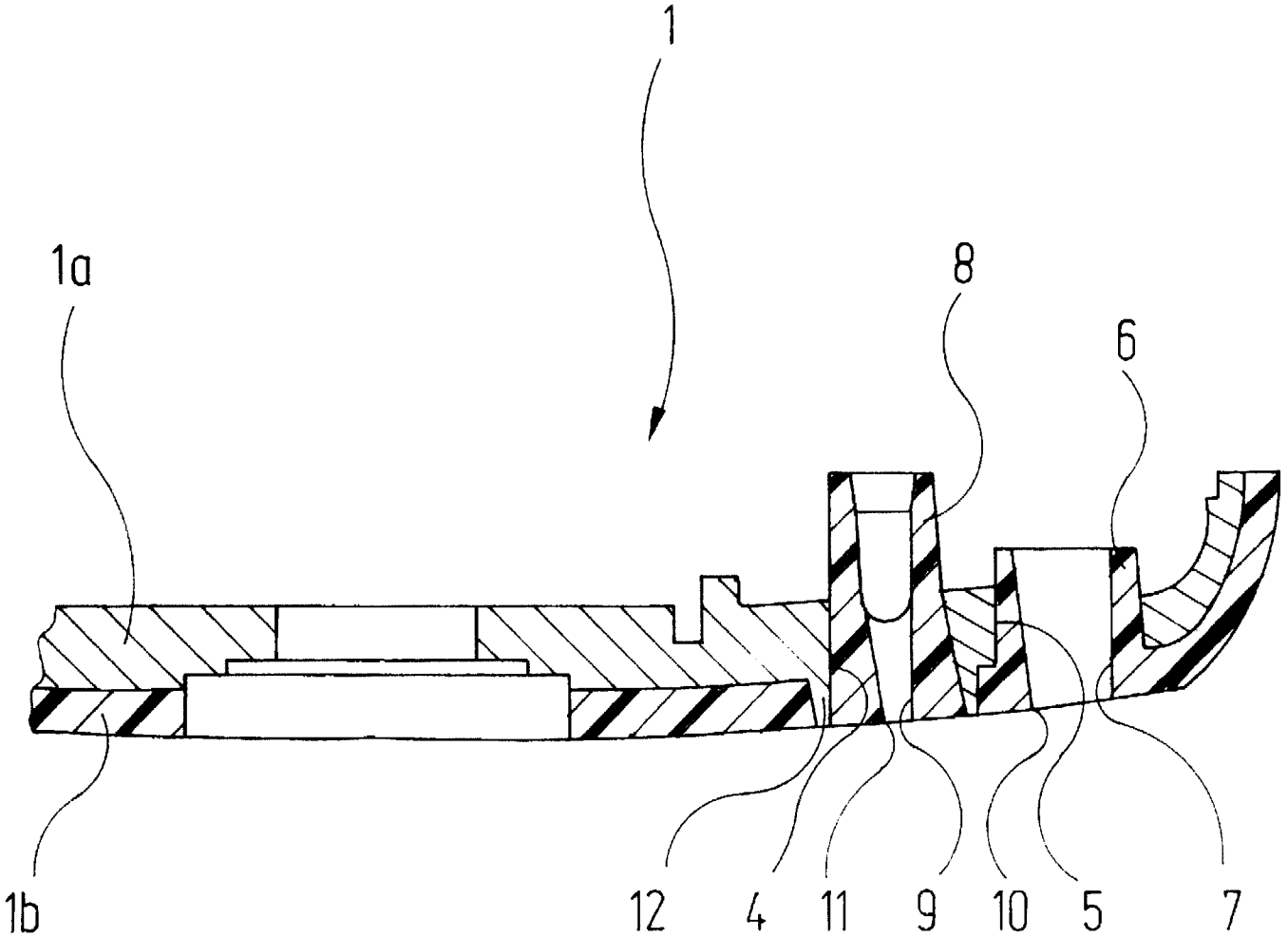

One embodiment of the invention is explained below in greater detail, with the aid of the drawings;

FIG. 1: shows the (partial) side view of a shower head, partly in section;

FIG. 2: shows a plan view of the shower base of the shower head shown in FIG. 1;

FIG. 3: shows a part section through the shower base shown in FIG. 2, but in larger scale.

FIG. 1 shows the side view of a shower head which is part of a hand shower. The shower head consists, in the generally known manner, of a bell-shaped housing 2, the open, bottom end of which is sealed by a multi-part shower base 1. The shower base 1 is attached, in a manner which will not be explained here in greater detail, to the components of the shower head housed inside the housing 2 by means of a central screw 3, such that it can be detached.

To provide a further description of the assembly of the spray head 1, reference is from now on made to FIG. 3, in which the shower base 1 is partially shown and in larger scale. According to this figure, the shower base 1 consists of a perforated plate 1*a* which is made of a relatively rigid synthetic material and the outer surface of which, i.e. the surface pointing downwards in FIG. 1 is covered by an impact protection plate 1*b* made of a relatively flexible material. The impact protection plate 1*b* can also, like all the components still to be described which are made of the same, relatively soft, flexible synthetic material, be injection moulded on to the perforated plate 1*a* using the two-component technique. The impact protection plate 1*b* covers the entire top surface of the perforated plate 1*a*, with one exception, details of which will be given below.

The perforated plate 1*a* of the shower base 1 consists, in the generally known manner, of several sets of holes 4, 5 which are arranged in concentric circles at regular angular distances around the center of the shower base 1 (cf FIG. 2). In this design, the exact hole pattern formed by the holes 4, 5 in the perforated plate 1*a* is of no significance.

The somewhat larger diameter holes 5 in the perforated plate 1*a* each have a hose-type jet insert 6 going through them which has a relatively short axial length and therefore protrudes only slightly above the top (facing inside the housing 2 of the shower head) side of the perforated plate 1*a*. Each of the hose-type jet inserts 6 have a jet channel 7 of relatively large cross-section going axially through them, which in the embodiment illustrated tapers conically towards the outside. The hose-type jet inserts 6 are, in addition, preformed in one piece on the impact protection plate and are made of the same material as this.

Hose-type jet inserts 8 also go through each of the holes 4 in the perforated plate 1*a*, but these have a greater axial length than the jet inserts 6 and consequently they protrude further on the inside of the perforated plate 1*a*. Jet channels 9 also go through each of the hose-type jet inserts 8 which have a smaller cross-section compared with the jet channels 7 through the jet inserts 6. Also, each of the jet channels 9 tapers from inside outwards.

The outlet openings 10 in the jet channels 7 in the hose-type jet inserts 6 can very clearly be recognised in FIG. 2, as can the outlet openings 11 in the jet channels 9 in the hose-type jet inserts 8. This figure illustrates the different cross-sectional surfaces of the outlet openings 10 and 11 more clearly than FIG. 3.

In contrast with the jet inserts 6, the jet inserts 8 are not connected directly to the impact protection plate 4. instead, preformed on to the rigid perforated plate 1*a*, in the area around each hole 4, is a small cylindrical, collar-type lug 12, which protrudes outwards from the perforated plate 1*a* and acts as a cylindrical shell to separate the outer area of the associated hose-type jet insert 8 from the adjacent area of the impact protection plate 1*b*.

When the shower base 1, as illustrated in FIG. 1, is mounted on the housing 2 of the shower head, the axially shorter hose-type jet inserts 6 extend into a first water chamber formed inside the housing 2. In contrast, the axially internally located ends of the axially longer hose-type jet inserts S are contained in holes 14 in an inner dividing wall 15, which separates the first water chamber 13 inside the housing 2 from a second water chamber 16 which is further away from the shower base 1.

The shower head described operates as follows:

The water flowing in the known manner through the handle 2*a* of the shower head is transferred either to the first water chamber 13 or to the second water chamber 16, as required, by means of a change-over mechanism which is operated via a rocker-type actuating device 17.

If the change-over mechanism is set so that the water flows into the first water chamber 13, then from there it can flow out via the jet channels 7 in the hose-type jet inserts 6 and their outlet openings. Owing to the relatively large diameter of the outlet openings 10, relatively slow, large diameter jets of water are produced which are known as "soft jets". Accordingly there is also no very high pressure build-up in the first water chamber. The risk of the relatively soft, flexible material of which the jet inserts 6 are made deforming is therefore only slight. The jet pattern presented by the jets of water flowing out of the outlet openings 10 is therefore to a large extent not dependent upon the pressure present in the first water chamber 13, even without any special protection measures.

If the change-over mechanism is actuated by the rocker-type actuating device 17 so that the water flowing through the handle 2*a* reaches the second water chamber, then this water overflows through the holes 14 in the dividing wall 15 in the hose-type jet inserts 8 in the shower base 1. The water passing through the relatively narrow jet channels 9 in the hose-type jet inserts 8, and especially at the ends where it tapers conically towards the outlet opening 11 accelerates considerably; it emerges from the openings 11 at high speed in the form of a relatively narrow jet. These jets of water are therefore also called "hard jets".

Given that the effect of the relatively narrow jet channels 11 in the hose-type jet inserts 8 is to considerably throttle the water flowing through them, a significantly high pressure can build up in the second water chamber 16 and in the jet channels 9 to which they are linked. If the material from which the hose-type jet inserts 8 and the impact protection plate 1*b* are made is very soft, then without the collar-shaped lugs 12 there would be a risk that the hose-type jet inserts 8 would deform under the pressure of the water flowing through them, and that therefore particularly the outlet openings 11 would become radially enlarged in an uncontrolled fashion. As a result, the uniform pattern of the "hard jets" would be impaired. This is, however, prevented by the collar-shaped lugs 12 surrounding the outlet openings 11. The radial distance between the collar-shaped lugs 12 and the outlet openings 11, and therefore the width of the ring formed between these from the soft, flexible material of the hose-type jet inserts 8 is selected so that on the one hand it is still relatively simple to achieve an elastic flexing of the hose-type jet inserts 8 in the area around the outlet openings 11 in order to strip off and dislodge limescale deposits, but on the other there is so little volume of flexible material to deform when the water is flowing through the jet channels 9 that a good jet pattern, which is largely independent of pressure, can be obtained for the hard jets.

As FIG. 2 especially shows, virtually the entire outer surface of the shower base 1 is covered by the impact protection plate 1*b*, with the result that mechanical damage is virtually eliminated. Only the very narrow rings which are formed by the outer faces of the cylindrical collar-shaped lugs 12 break the impact protection plate 1*b*, but this does not impair its protection function to any appreciable extent.

Should it become necessary to remove limescale deposits from inside the jet channels 7 and 9 in the shower base 1, especially in the area around their outlet openings 10 or 11, the user can run his finger, applying light pressure upwards, along the underside of the shower base 1. This action compresses the impact protection plate 1*b* and the jet inserts 6 and 8 in the area around the outlet openings 10 and 11. As the finger travels over the base it meets no special resistance as long as it remains in the area of the impact protection plate 1*b* and the hose-type jet inserts 6 (soft jets). This would not be the case, however, if the finger being used for cleaning were to move to an outlet opening 11 in the hose-type jet inserts 8 (hard jets): in this case, shortly before reaching the actual outlet openings 11, it would come up against a certain amount of resistance caused by the hard, collar-type lugs 12 in the perforated plate 1*a*. The user will therefore instinctively increase the pressure applied by his finger in order to overcome the resistance presented. His finger then goes in to the area surrounded by the collar-type lug 12 with rather more force, with a result that the local deformation which is caused by the cleaning finger in the outer face of the hose-type jet inserts 8 ends up somewhat higher than it would without the collar-shaped lugs.

I claim:

1. Shower head comprising:

a) an essentially bell-shaped housing, in which at least one water chamber is formed which can be connected to a water supply channel;

b) a shower base, which seals a bottom of the bell-shaped housing and comprises:

ba) a perforated plate made of a rigid material, which has a number of holes;

bb) a number of hose-type jet inserts, which are made of a relatively soft, flexible material, each of which has a jet channel going through them terminating in a water outlet opening and each of which passes through a hole in the perforated plate, wherein:

c) essentially the entire outer surface of the perforated plate (1*a*) is covered by an impact protection plate (1*b*) made of a relatively soft, flexible material, in which, however, d) there are, preformed on to the rigid perforated plate (1*a*), a number of collar-shaped lugs (12) which go around the outer area of at least some of the hose type-jet inserts (6, 8) and separate these from the impact protection plate (1*b*).

2. Shower head according to claim 1 with a first set of hose-type jet inserts, each of which have a relatively wide jet channel and produce soft jets which have a relatively slow speed and a large cross-section, and with a second set of hose-type jet inserts, each of which has a relatively narrow jet channel and produce relatively high-speed hard jets with a small cross-section, characterised in that the collar-shaped lugs (12) on the perforated plate (1*a*) are only fitted to those hose-type jet inserts (8) which produce the hard jets, whilst the hose-type jet inserts (6) which produce the soft jets are preformed in one piece on the impact protection plate (1*b*).

3. Shower head according to claim 1, characterised in that the hose-type jet inserts (6) which produce the soft jets and the hose-type jet inserts which produce the hard jets have a different axial length.

4. Shower head according to claim 1, characterised in that the hose-type jet inserts (6, 8) and the impact protection plate (1*b*) are made of the same material.

5. Shower head according to claim 1, characterised in that the hose-type jet inserts (6, 8) and the impact protection plate (1*b*) are injection moulded on to the perforated plate 1*a* using the two-component technique.

6. Shower head according to claim 1, characterised in that the hose-type jet inserts and/or the impact protection plate are attached to the perforated plate in such a way that allows them to be removed.

7. Shower head according to claim 6, characterised in that the hose-type jet inserts and/or the impact protection plate are flexibly mounted on the perforated plate.

* * * * *